United States Patent [19]

Jochum et al.

[11] 4,122,987

[45] Oct. 31, 1978

[54] DAMPING DEVICE FOR A FASTENING ELEMENT SETTING GUN

[75] Inventors: Peter Jochum, Meiningen, Austria; Eugen Schilter, Zurich, Switzerland

[73] Assignee: Hilti Aktiengesellschaft, Schaan, Liechtenstein

[21] Appl. No.: 814,930

[22] Filed: Jul. 12, 1977

[30] Foreign Application Priority Data

Jul. 19, 1976 [DE] Fed. Rep. of Germany ..... 2632413

[51] Int. Cl.[2] ..... B25C 1/14

[52] U.S. Cl. ..... 227/10

[58] Field of Search ..... 227/8, 10, 11; 213/33, 213/34; 267/9 B, 134, 135, 137

[56] References Cited

U.S. PATENT DOCUMENTS

| | | | |
|---|---|---|---|
| 1,515,346 | 11/1924 | Kreissig | 267/135 |
| 3,172,119 | 3/1965 | Siddons | 227/10 |
| 3,331,546 | 7/1967 | Brunelle | 227/10 |
| 3,566,978 | 3/1971 | Udert | 227/10 |

*Primary Examiner*—Granville Y. Custer, Jr.

*Attorney, Agent, or Firm*—Toren, McGeady and Stanger

[57] ABSTRACT

In a setting gun using explosive force for driving fastening elements into a receiving material, an elastic damping device is provided to absorb the residual kinetic energy of a driving piston. The damping device consists of a plurality of serially arranged pairs of rings extending between a muzzle tube and a stop ring mounted in the forward end of a barrel. Each pair of rings consists of a radially inner ring and a radially outer ring each having a frusto-conical surface in contact with the other. The frusto-conical surfaces converge in the firing direction of the setting gun. In one embodiment, each pair of rings has the same axial length, however, in another embodiment the axial length of the rings increases in the firing direction of the setting gun so that the mass of the pairs of rings increases in the firing direction.

7 Claims, 3 Drawing Figures

DAMPING DEVICE FOR A FASTENING ELEMENT SETTING GUN

SUMMARY OF THE INVENTION

The present invention concerns a setting gun using explosive force for driving fastening elements into a receiving material and, more particularly, it is directed to a gun including a barrel within which a driving piston is displaceably mounted for movement into a muzzle tube from which a fastening element is driven into the receiving material. For absorbing residual kinetic energy of the driving piston, a damping device is provided between the muzzle tube and the barrel with a stop ring mounted in the front end of the barrel and supporting the rearward end of the damping device. As the driving piston is propelled by explosive force through the barrel a gas cushion is formed between the head of the piston and the stop ring for displacing the stop ring in the firing direction against the damping device before the piston head contacts the stop ring.

Such setting guns utilizing a driving piston have among others, the considerable advantage that the driving piston can be stopped by means provided on the gun after the bolt has been driven into the receiving material, this prevents the bolt from penetrating too deeply into the material. In known setting guns, the piston head impacts against a stop ring, after the bolt has reached the desired degree of penetration, and the stop ring in turn moves against a front muzzle tube via a damping device consisting of circular springs arranged in series. Depending on the extent of the residual kinetic energy remaining in the driving piston which must be absorbed, the piston is arrested within the spring path of the damping device. In other words, if only a small residual kinetic energy is present, the piston causes only a slight contraction of the damping device, and if a higher residual energy is present, the amount of contraction is greater.

In these known devices, the circular springs have two conical contact surfaces inclined to one another in opposite directions. Each of the contact surfaces cooperates with a correspondingly inclined contact surface on an adjoining ring. The end rings of the damping device are bisected and, as a result, have only one inclined contact surface which corresponds to the outer contact surface of the forwardmost or rearwardmost full ring.

Other damping devices are known where inner rings have two oppositely inclined contact surfaces, while the outer rings have only one contact surface which cooperates with a correspondingly inclined contact surface on an inner ring.

In these two known setting guns, the stop ring is pressed by the damping device against the barrel. Additionally, the stop ring laterally encloses the shank of the driving piston, that is, the reduced diameter portion extending forwardly of the piston head. Accordingly, a seal is formed between the stop ring and the barrel, as well as between the stop ring and the driving piston, and it causes the formation of a gas cushion between the piston head and the stop ring. The gas cushion is compressed as the piston is impelled forwardly through the barrel. To increase the pressure of the gas cushion, it has been known to conduct propellant gases from behind the piston head to in front of it, after the acceleration of the driving piston has been completed.

The compression of the gas cushion as the driving piston head advances has the result that the stop ring is moved forwardly against the force of the damping pack by the gas cushion and by the piston head, while the head moves substantially faster and strikes the displaced stop ring with a relatively high rate of speed. Since the impact velocity of the piston head is rather high, high compressive forces are developed in the collision of these two parts which results in premature destruction of the parts. Accordingly, the end rings of the damping device which have only one contact surface are overstressed during each braking action and become prematurely inoperative. Further, the great mass of the known rings in the damping device have been found to be disadvantageous, since the mass counteracts to a great extent the axial acceleration of the stop ring produced by the gas cushion. This result is one of the main reasons why the velocity of the ring at the time of the impact of the piston head against it is too low, causing the above difficulties.

Therefore, it is a primary object of the present invention to miminize the impact forces of the driving piston on the stop ring in a setting gun of the above type.

In accordance with the present invention, the impact forces on the stop ring are reduced by the use of a damping device consisting of a number of pairs of rings arranged in series. Each pair of rings consists of a radially outer ring and a radially inner ring each contacting the other over correspondingly shaped frusto-conical surfaces. Further, the transversely extending forward end face of the outer ring extends forwardly of the corresponding end face of the inner ring. In accordance with the present invention, the rings constituting the damping device have only the one contact surface, so that the total axial length of the ring is about half that of conventional rings having two contact surfaces. In this manner the rings of the invention have only half the mass of the previously known rings. Accordingly, only a small mass moment of inertia resists the movement of the stop ring propelled in the driving direction by the gas cushion located in front of the piston head as it is driven toward the muzzle end of the gun. With this construction, the stop ring develops a high velocity with the relative impact velocity of the piston head on the stop ring being minimal and, consequently, the compressive stresses on the abutting surfaces are also kept at a low level. The destruction of the end parts previously experienced is thus prevented.

The design of the damping device in accordance with the present invention has the further advantage that the individual rings in each pair and especially the end rings, are uniformly stressed and are not overstressed. This uniform stressing action results in a longer service life for the damping device.

Preferably, the contact surfaces of the rings in each pair extend in the same direction. Furthermore, the wide end faces of the rings in adjacent pairs bear against one another when pressure is applied against the damping device. When the damping device starts to contract, friction is developed not only on the frusto-conical contact surfaces caused by the telescoping action of the rings, but considerable friction is also produced on the end faces pressed against one another, because the rings in adjoining pairs are displaced radially to one another during the contracting action. Accordingly, the braking action is considerably increased.

Another feature of the invention is the arrangement of the contacting frusto-conical surfaces all disposed in the same direction tapering inwardly toward the muzzle end of the setting gun. As a result, only the radially inner ring of the rearmost pair of rings needs to be supported by the stop ring and the stop rings can be made smaller in size, that is, having a smaller mass. By reducing its mass, the acceleration of the stop ring is facilitated. Furthermore, the acceleration of the stop ring is increased as the driving piston commences its movement through the barrel due to the fact that the inner ring bearing directly against the stop ring offers less mass inertia to the stop ring and the inner ring has a smaller mass than the outer ring.

Another advantage of the present invention is the provision of an improved sealing effect afforded by the cooperation of the rearmost inner ring with the stop ring and of the stop ring with the shank for the driving piston. This sealing action has a positive effect on the buildup of the gas pressure in front of the piston head with a comparable effect on the acceleration of the stop ring.

In one preferred embodiment, the mass of the pairs of rings increases toward the muzzle end of the setting gun. It has proven advantageous to arrange the pairs of rings with a continuously increasing mass toward the muzzle end. The smaller mass of the pairs of rings adjacent the barrel ensures that the stop ring encounters relatively small inertia forces at the outset of the acceleration process. The pairs of rings with a greater mass, however, can absorb high forces and effectively absorb the kinetic energy of the driving piston and the stop ring during the latter portion of the advance of the stop ring.

In still another feature of the invention, the size of the cone angles of the frusto-conical contact surfaces of the individual pairs of rings decreases proportionally to the increase in the masses of the pairs. Accordingly, it is possible to obtain substantially equal friction surfaces in the pairs of rings with a large as well as a small mass or cross section, so that the braking action of the damping device ensures good values. To avoid any impairment of the axial telescoping of the individual pairs of rings, the cone angle of the contacting surfaces of the small mass should be less than 60°.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in whcih there are illustrated and described preferred embodiments of the invention.

DETAILED DESCRIPTION OF THE INVENTION

Figure 1:
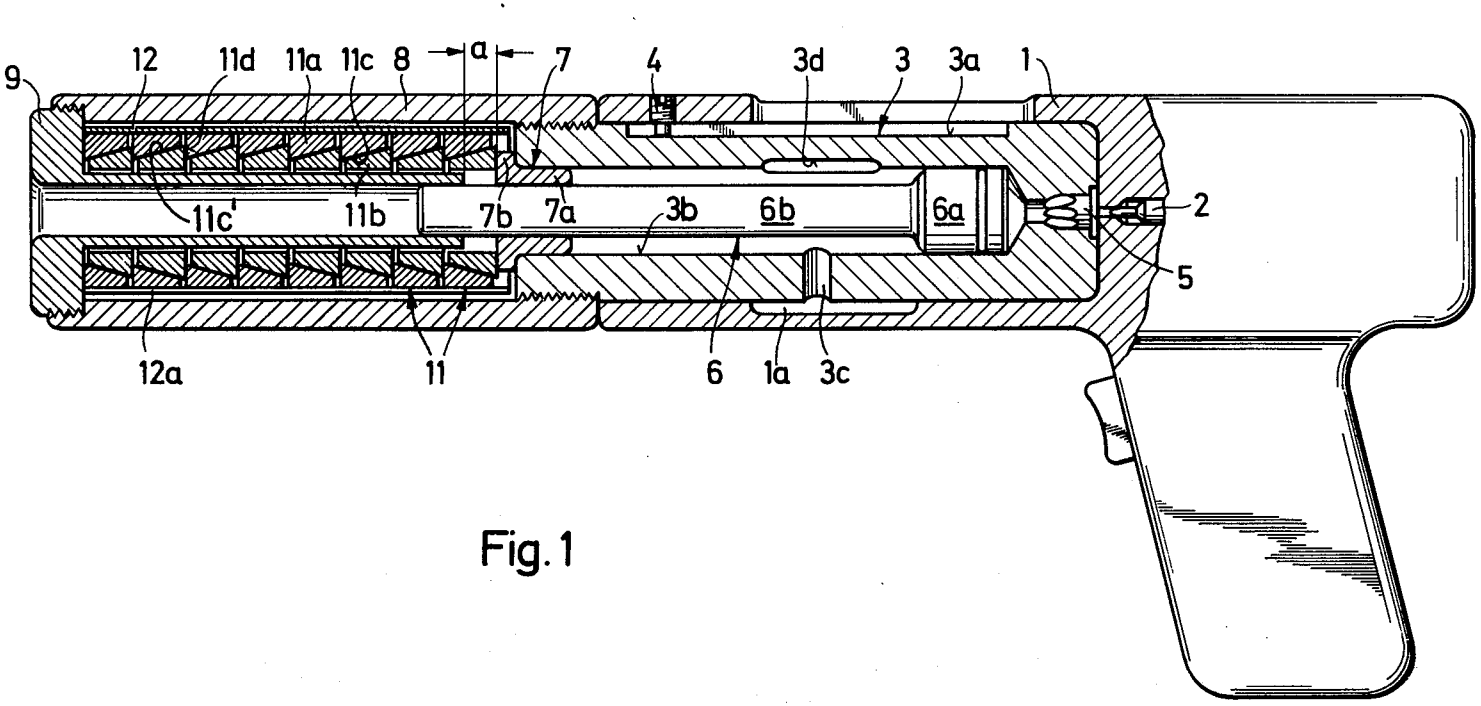
FIG. 1 is a side view, partly in section, of a setting gun embodying the present invention and illustrated in the firing position.

In FIG. 1, a setting gun using explosive force for driving fastening elements into a receiving material is illustrated and the gun includes a housing 1 containing a firing pin 2 of a known firing mechanism, not shown. A barrel 3 is axially displaceably mounted within the housing 1. Displacement of the barrel is limited by a stop screw 4 positioned in the housing and extending into a longitudinally or axially extending groove **3*a* in the barrel 3. At its rear end, the barrel 3 has a chamber opening into its bore 3*b* and the chamber contains a cartridge 5 whose propellant gases impel a driving piston 6 through the bore 3*b* when the cartridge is fired. Driving piston 6 consists of a rear piston head 6*a* with a smaller diameter piston shank 6*b* extending forwardly of the head. The larger diameter head is in sliding contact with the surface of the bore 3*b*. The surface of shank 6*b* is spaced radially inwardly from the surface of the bore 3*b* and extends through a stop ring 7 fitted into the forward end of the barrel 3. At its forward end, a sleeve 8 is screwed onto the barrel 3 and extends forwardly of the barrel. A muzzle tube 9 is threaded into the forward end of the sleeve 8 and has a reduced diameter section extending axially through the sleeve toward the forward end of the barrel. The rearward end of the muzzle tube 9, however, is spaced forwardly of the forward end of the stop ring 7** by the dimension "*a*". Further, the outer surface of the reduced diameter part of the muzzle tube is spaced radially inwardly from the inner surface of the sleeve 8 forming an annular space therebetween extending from the stop ring to the larger diameter forward end portion of the muzzle tube.

To prepare the setting gun for operation, a fastening element, not shown, is inserted into the muzzle tube 9. In driving the fastening element into a receiving material, shank **6*b* of the driving piston 6 moves forwardly through the muzzle tube propelling the fastening element out of the setting gun. Positioned in the annular space encircling the smaller diameter portion of the muzzle tube 9 and within the sleeve 8 is a damping device. The damping device presses at one end against the shoulder provided by the larger diameter forward end of the muzzle tube and at its opposite end presses against the forward end of the stop ring 7. At its forward end, the stop ring 7 has an annular flange 7*b* extending radially outwardly from the bore 3*b* and disposed in contact with the forward end of the barrel. A sleeve-like section 7*a* of the stop ring 7 extends rearwardly from the flange 7*b* within the bore 3*b*. The radially inner surface of the sleeve-like section 7*a* is in contact with the surface of the shank 6*b*. The damping device extending between the stop ring and the shoulder on the muzzle tube is made up of a number of serially arranged pairs of rings 11** and each pair is of a similar construction.

Each pair of rings 11 consists of a radially outer ring **11*a* and a radially inner ring 11*b* and the outer ring has a radially inner frusto-conical surface 11*c* which contacts a similarly shaped frusto-conical surface 11*c* on the radially outer surface of the inner ring. The contact surfaces 11*c* in each pair of rings extend in the same direction, that is, the frusto-conical surfaces converge inwardly in the direction toward the forward end of the muzzle tube. As shown in the uncompressed condition in FIG. 1, the wider forward end face 11*d* of each outer ring contacts the wider end face of the inner ring in the next forward pair of rings. The pairs of rings 11 are mounted within a pipe 12 which has an axial or longitudinal slot 12*a*** to provide radial resilience. This arrangement of the pipe facilitates the assembly of the damping device.

When the cartridge 5 is detonated by firing pin 2, the gases generated by the explosion expand and accelerate the driving piston through the bore **3*b*. To avoid any interference with this accelerating action, compressing the air contained in the bore 3b forwardly of the piston head 6a must be prevented. Accordingly, an outflow opening 3c is provided through the barrel opening into an annular slot 1a in the housing from where it flows into the atmosphere. As the piston moves forwardly, its head 6a covers the opening 3c and the compressed explosion gases rearwardly of the head flow through a bypass 3d forwardly of the head. As the driving piston 6 continues to move through the bore 3b, its head moves across the bypass 3d and ahead of it so that the gases in the bore forward of the head 6a are compressed by the continued advance of the driving piston, since stop ring 7 prevents any leakage of these gases by providing a tight seal with the barrel 3 and also with the piston shank 6b. As soon as the pressure of the compressed gas overcomes the spring force of the damping device 11 which compresses the stop ring 7 against the forward end of the barrel, the stop ring is propelled by the gas cushion against the damping device. At the time of the highest velocity of the stop ring caused by the gas cushion, the trailing head 6a on the piston strikes against the rearward end of the sleeve-like section 7a of the stop ring. Due to the high velocity achieved by the stop ring 7, the relative striking velocity of the head 6a** against the stop ring and thus also of the compressive stresses generated, are minimal. As a result, these contacting parts are not damaged.

The path for the acceleration of the stop ring 7 and for stopping the driving piston 6 is provided by the spacing "*a*", note FIG. 1, between the forward end face of the stop ring and the trailing end face of the smaller diameter section of the muzzle tube. This dimension "*a*" refers to the spacing between the stop ring and the trailing end of the muzzle tube when the damping device is in the uncompressed condition. Further, the dimension "*a*" corresponds to the sum of the individual axial displacements of each of the pairs of rings 11. The braking force afforded by the damping device is provided, on the one hand, in a conventional manner by the pressure developed during the telescoping of the frusto-conical surfaces 11c on the outer rings 11a and the inner rings 11b of each pair, this telescoping action develops friction between the corresponding contact surfaces. On the other hand, however, the braking force is increased due to the frictional engagement of the transverse end faces 11d at the forward end of the outer rings and the trailing ends of the inner rings, which surfaces are in engagement. During contraction and expansion of the damping devices, these contacting end faces 11d are displaced radially in opposite directions and produce additional friction.

The cooperating parts of the setting gun are designed so that, with maximum compression of the damping device, the driving piston stopped in the forwardmost position drives a fastening element into the receiving material for an optimum depth.

Figure 2:
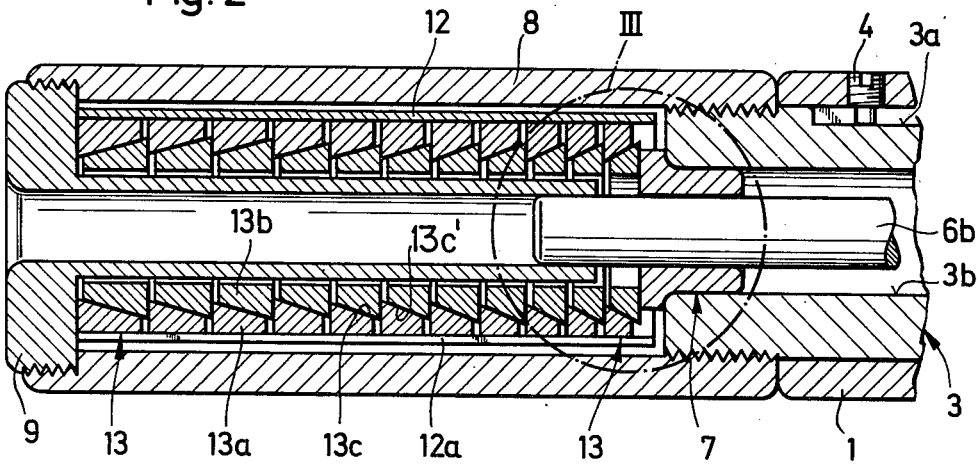
FIG. 2 is a sectional view of the forward portion of a setting gun, similar to that shown in FIG. 1, but embodying a different arrangement of the damping device.

In FIG. 2 another embodiment of the damping device is illustrated. In this embodiment, parts which are identical to those shown in FIG. 1 have the same reference numerals. As distinguished from the damping device in FIG. 1, the device in FIG. 2 consists of a plurality of pairs of rings 13 each having a different axial length. As a consequence of this difference, each of the individual pairs of rings has a different mass. As can be noted in FIG. 2, the axial length and the mass of each pair of rings increases from the forward end of the stop ring 7 to the rearwardly facing shoulder at the forward end of the muzzle tube 9. Since the pairs of rings 13 adjacent the stop ring 7 have a smaller mass, it is possible for the stop ring to accelerate more easily. Since the stop ring can accelerate more easily, it has a higher velocity at the time of the impact of the piston head 6a against it and, accordingly, the impact is minimal. To assure the frictional engagement provided in the arrangement of the damping device displayed in FIG. 1, the frusto-conical contact surfaces 13c' of the outer rings 13a and the inner rings 13b, respectively, have an increasing cone angle with the decreasing mass of the pairs of rings 13. In other words, the cone angle of the frusto-conical contact surfaces is greatest at the rearwardmost pair of rings and decreases to the forward end of the damping device. Due to the greater cone angle of the contact surfaces 13c with a smaller mass at the smaller area of contact, a sufficient axial load capacity is attained, since the force component acting radially on the outer ring 13a and the inner ring 13b is kept low.

Figure 3:
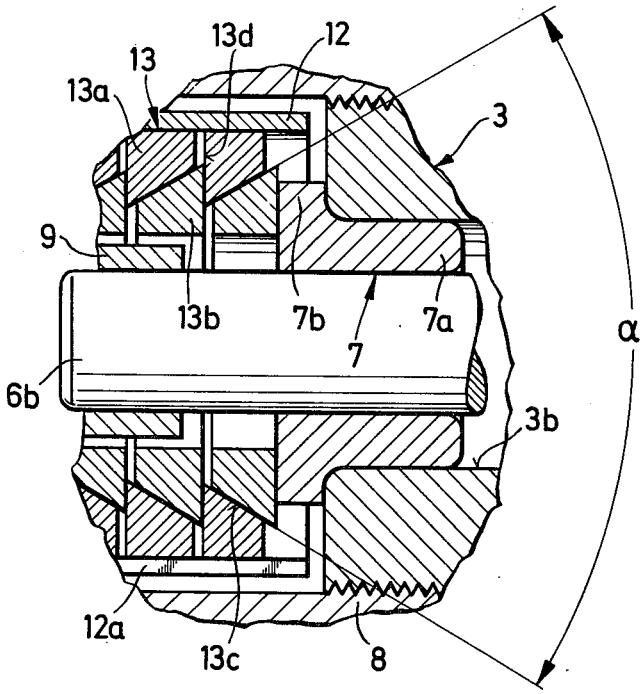
FIG. 3 is an enlarged detail view of the encircled portion of FIG. 2 identified by III.

As illustrated in FIG. 3, the cone angle $\alpha$ of the contact surfaces 13c should be less than 60°. As in the arrangement of the damping device shown in FIG. 1, in the embodiment exhibited in FIGS. 2 and 3, the wider forward end face of each outer ring 13a is in contact with the trailing wider end face of the preceding inner ring 13b.

The mode of operation of the damping device shown in FIGS. 2 and 3 corresponds to that of the embodiment illustrated in FIG. 1.

While specific embodiments of the invention have been shown and described in detail to illustrate the application of the inventive principles, it will be understood that the invention may be embodied otherwise without departing from such principle.

What is claimed is:

1. A setting gun using explosive force for propelling fastening elements into a receiving material comprising an axially elongated barrel forming an axially elongated bore, said bore having a forward end and a rearward end, an axially elongated muzzle tube aligned with and located forwardly of the forward end of said bore, a driving piston axially displaceably mounted within the bore in said barrel and extending forwardly of said barrel into said muzzle tube and being axially displaceable therethrough, an elastic damping device extending in the elongated axial direction of said barrel and located radially outwardly of said muzzle tube and extending in the axial direction between said muzzle tube and said barrel, said damping device having a forward end in contact with said muzzle tube and a rearward end, a stop ring located at and in contact with the forward end of said barrel and extending into contact with the rearward end of said damping device, said stop ring extending into the bore in said barrel, said driving piston comprising a head and an axially elongated shank extending forwardly of said head, said shank being axially displaceable through said stop ring, said stop ring having a forward end and a rearward end with the forward end disposed in contact with the rearward end of said damping device and the rearward end being in the path of movement of the head of said driving piston so that said stop ring is pressed forwardly against said damping device by a gas cushion within the bore as the head on said driving piston moves forwardly through the bore in said barrel, wherein the improvement comprises that said damping device comprises a plurality of pairs of rings arranged in series in the axial direction of said muzzle tube, each said pair of rings comprising an outer ring and an inner ring positioned radially inwardly of said outer ring, each said outer ring having a radially inwardly facing surface, each said inner ring having a radially outwardly facing surface, in each said pair of rings the radially inwardly facing surface on said outer ring being disposed in contact with the radially outwardly facing surface on said inner ring, each said outer and inner ring having a forward end face and a rearward end face each of which extends transversely of the axial direction of said muzzle tube, said damping device being displaceable when the setting gun is fired from an uncompressed condition to a compressed condition where said driving piston is displaced forwardly through the bore in said barrel and said muzzle tube, in the uncompressed condition of said damping device each said pair of rings having the forward end face of said outer ring extending axially forwardly of the forward end face of said inner ring and disposed in contact with the rearward end face of said inner ring in the next forwardly positioned said pair of rings and spaced axially rearwardly from the rearward end face of said outer ring in the next forwardly positioned said pair of rings, said radially inwardly facing surface on said outer ring and said radially outwardly facing surface on said inner ring of each said pair of rings extends in the same direction, said radially inwardly facing surface of said outer ring and said radially outwardly facing surface of said inner ring in each said pair of rings are frusto-conically shaped and converge inwardly in the axial direction toward the forward end of said muzzle tube, and the axial length of each of said pair of rings increases in the direction extending from said stop ring toward the forward end of said muzzle tube so that said pairs of rings have increasing masses toward the forward end of said muzzle tube.

2. A setting gun, as set forth in claim 1, wherein the cone angle of said frusto-conically shaped radially inwardly facing surface on said outer rings and said radially outwardly facing surface on said inner rings decreasing in proportion to the corresponding increase in the axial length of said pairs of rings.

3. A setting gun, as set forth in claim 2, wherein said stop ring comprises a sleeve-like section fitted into the forward end of said barrel and an annular flange extending outwardly from the forward end of said sleeve-like section and disposed in surface contact with the forward end of said barrel in the uncompressed condition of said damping device.

4. A setting gun using explosive force for propelling fastening elements into a receiving material comprising an axially elongated barrel forming an axially elongated bore, said bore having a forward end and a rearward end, an axially elongated muzzle tube aligned with and located forwardly of the forward end of said bore, a driving piston axially displaceably mounted within the bore in said barrel and extending forwardly of said barrel into said muzzle tube and being axially displaceable therethrough, an elastic damping device extending in the elongated axial direction of said barrel and located radially outwardly of said muzzle tube and extending in the axial direction between said muzzle tube and said barrel, said damping device having a forward end in contact with said muzzle tube and a rearward end, a stop ring located at and in contact with the forward end of said barrel and extending into contact with the rearward end of said damping device, said stop ring extending into the bore in said barrel, said driving piston comprising a head and an axially elongated shank extending forwardly of said head, said shank being axially displaceable through said stop ring, said stop ring having a forward end and a rearward end with the forward end disposed in contact with the rearward end of said damping device and the rearward end being in the path of movement of the head of said driving piston so that said stop ring is pressed forwardly against said damping device by a gas cushion within the bore as the head on said driving piston moves forwardly through the bore in said barrel, wherein the improvement comprises that said damping device comprises a plurality of pairs of rings arranged in series in the axial direction of said muzzle tube, each said pair of rings comprising an outer ring and an inner ring positioned radially inwardly of said outer ring, each said outer ring having a radially inwardly facing surface, each said inner ring having a radially outwardly facing surfaces, in each said pair of rings the radially inwardly facing surface on said outer ring being disposed in contact with the radially outwardly facing surface on said inner ring, each said outer and inner ring having a forward end face and a rearward end face each of which extends transversely of the axial direction of said muzzle tube, said damping device being displaceable when the setting gun is fired from an uncompressed condition to a compressed condition where said driving piston is displaced forwardly through the bore in said barrel and said muzzle tube, in the uncompressed condition of said damping device each said pair of rings having the forward end face of said outer ring extending axially forwardly of the forward end face of said inner ring and disposed in contact with the rearward end face of said inner ring in the next forwardly positioned said pair of rings and spaced axially rearwardly from the rearward end face of said outer ring in the next forwardly positioned said pair of rings, an axially elongated sleeve having a forward end and a rearward end has said rearward end removably secured to the forward end of said barrel and extends forwardly therefrom and laterally encloses said damping device, said muzzle tube having a forward end and a rearward end with the forward end of said muzzle tube removably secured to the forward end of said sleeve spaced axially forwardly of said barrel and said muzzle tube extends rearwardly from its point of securement to said sleeve and the rearward end of said muzzle tube is spaced axially forwardly of the forward end of said stop ring in the uncompressed condition of said damping device and said muzzle tube is spaced radially inwardly from said sleeve forming an axially extending annular space therebetween with said damping device being located in the annular space between said sleeve and said muzzle tube.

5. A setting gun, as set forth in claim 4, comprising a tubular member located within said sleeve and laterally enclosing said damping device from the forward end to the rearward end thereof.

6. A setting gun using explosive force for propelling fastening elements into a receiving material comprising an axially elongated barrel forming an axially elongated bore, said bore having a forward end and a rearward end, an axially elongated muzzle tube aligned with and located forwardly of the forward end of said bore, a driving piston axially displaceably mounted within the bore in said barrel and extending forwardly of said barrel into said muzzle tube and being axially displaceable therethrough, an elastic damping device extending in the elongated axial direction of said barrel and located radially outwardly of said muzzle tube and extending in the axial direction between said muzzle tube and said barrel, said damping device having a forward end in contact with said muzzle tube and a rearward end, a stop ring located at and in contact with the forward end of said barrel and extending into contact with the rearward end of said damping device, said stop ring extending into the bore in said barrel, said driving piston comprising a head and an axially elongated shank extending forwardly of said head, said shank being axially displaceable through said stop ring, said stop ring having a forward end and a rearward end with the forward end disposed in contact with the rearward end of said damping device and the rearward end being in the path of movement of the head of said driving piston so that said stop ring is pressed forwardly against said damping device by a gas cushion within the bore so that head on said driving piston moves forwardly through the bore in said barrel, wherein the improvement comprises that said damping device comprises a plurality of pairs of rings arranged in series in the axial direction of said muzzle tube, each said pair of rings comprising an outer ring and an inner ring positioned radially inwardly of said outer ring, each said outer ring having a radially inwardly facing surface, each said inner ring having a radially outwardly facing surface, in each said pair of rings the radially inwardly facing surface on said outer ring being disposed in contact with the radially outwardly facing surface on said inner ring, each said outer and inner ring having a forward end face and a rearward end face each of which extends transversely of the axial direction of said muzzle tube, said damping device being displaceable when the setting gun is fired from an uncompressed condition to a compressed condition where said driving piston is displaced forwardly through the bore in said barrel and said muzzle tube, in the uncompressed condition of said damping device each said pair of rings having the forward end face of said outer ring extending axially forwardly of the forward end face of said inner ring and disposed in contact with the rearward end face of said inner ring in the next forwardly positioned said pair of rings and spaced axially rearwardly from the rearward end face of said outer ring in the next forwardly positioned said pair of rings, and means in said barrel for transmitting propellant gases driving said driving piston through said barrel from rearwardly of said head driving piston to forwardly of the head of said driving piston.

7. A setting gun using explosive force for propelling fastening elements into a receiving material comprising an axially elongated barrel forming an axially elongated bore, said bore having a forward end and a rearward end, an axially elongated muzzle tube aligned with and located forwardly of the forward end of said bore, a driving piston axially displaceably mounted within the bore is said barrel and extending forwardly of said barrel into said muzzle tube and being axially displaceable therethrough, an elastic damping device extending in the elongated axial direction of said barrel and located radially outwardly of said muzzle tube and extending in the axial direction between said muzzle tube and said barrel, said damping device having a forward end in contact with said muzzle tube and a rearward end, a stop ring located at and in contact with the forward end of said barrel and extending into contact with the rearward end of said damping device, said stop ring extending into the bore in said barrel, said driving piston comprising a head and an axially elongated shank extending forwardly of said head, said shank being axially displaceable through said stop ring, said stop ring having a forward end and a rearward end with the forward end disposed in contact with the rearward end of said damping device and the rearward end being in the path of movement of the head of said driving piston so that said stop ring is pressed forwardly against said damping device by a gas cushion within the bore as the head on said driving piston moves forwardly through the bore in said barrel, wherein the improvement comprises that said damping comprises a plurality of pairs of rings arranged in series in the axial direction of said muzzle tube, each said pair of rings comprising an outer ring and an inner ring positioned radially inwardly of said outer ring, each said outer ring having a radially inwardly facing surface, each said inner ring having a radially outwardly facing surface, in each said pair of rings the radially inwardly facing surface on said outer ring being disposed in contact with the radially outwardly facing surface on said inner ring, each said outer and inner ring having a forward end face and a rearward end face each of which extends transversely of the axial direction of said muzzle tube, said damping device being displaceable when the setting gun is fired from an uncompressed condition to a compressed condition where said driving piston is displaced forwardly through the bore in said barrel and said muzzle tube, in the uncompressed condition of said damping device each said pair of rings having the forward end face of said outer ring extending axially forwardly of the forward end face of said inner ring and disposed in contact with the rearward end face of said inner ring in the next forwardly positioned said pair of rings and spaced axially rearwardly from the rearward end face of said outer ring in the next forwardly positioned said pair of rings, and means in said barrel for releasing air from forwardly of said head of said driving piston as said driving piston is propelled forwardly through the bore in said barrel.

* * * * *